United States Patent [19]

Zegel et al.

[11] Patent Number: 4,976,080

[45] Date of Patent: Dec. 11, 1990

[54] WALL SYSTEM AND METHOD OF CONSTRUCTION

[75] Inventors: Douglas R. Zegel, Morrestown, N.J.; Gary S. Jensen, Drexel Hill, Pa.; Mark R. Hernick, Prospect Park, Pa.; Michael J. Daniels, Doylestown, Pa.

[73] Assignee: Art Guild, Inc., West Deptford, N.J.

[21] Appl. No.: 285,763

[22] Filed: Dec. 16, 1988

[51] Int. Cl.[5] ..... E04H 5/00

[52] U.S. Cl. ..... 52/239; 52/238.1

[58] Field of Search ..... 52/238.1, 239, 64, 70, 52/71, 127.9, 284, 285

[56] References Cited

U.S. PATENT DOCUMENTS

| | | | |
|---|---|---|---|
| 2,969,565 | 1/1961 | Levy | 52/239 X |
| 3,861,101 | 1/1975 | Whisson | 52/238.1 |
| 4,056,985 | 11/1977 | Worrallo | 52/239 X |
| 4,535,577 | 8/1985 | Tenser et al. | 52/238.1 X |
| 4,682,457 | 7/1987 | Spencer | 52/339 |

FOREIGN PATENT DOCUMENTS

| | | | |
|---|---|---|---|
| 248701 | 1/1963 | Australia | 52/238.1 |

OTHER PUBLICATIONS

Foga System, 1982, 40 pages.

Gold Bond Building Products (undated), 7 pages.

Giltspur (undatd), 9 pages.

Rotolock (undated), 2 pages.

Syma Systems, Inc. (undated), 1 page.

*Primary Examiner*—David A. Scherbel

*Assistant Examiner*—Creighton Smith

*Attorney, Agent, or Firm*—Volpe and Koenig

[57] ABSTRACT

A wall system is comprised of wall frame components and wall covering components. The wall frame components include a pair of space vertical supports and an array of selectively spaced cross members spanning between and rigidly attached to the vertical supports. Pinch bars, designed to matingly engage the frame cross members are mounted on wall covering components in a matching spaced array. The wall covering components are secured to the wall frame component by matingly engaging the pinch bars with the cross member supports.

The wall frames include locking connectors such that vertical supports of multiple frame components are serially locked together to form a wall system of any desired floor plan configuration. An infinitely variable hinge frame corner connector and a universal medial connector facilitate the construction of non-linear and/or complex floor plan configurations.

9 Claims, 4 Drawing Sheets

FIG. 1
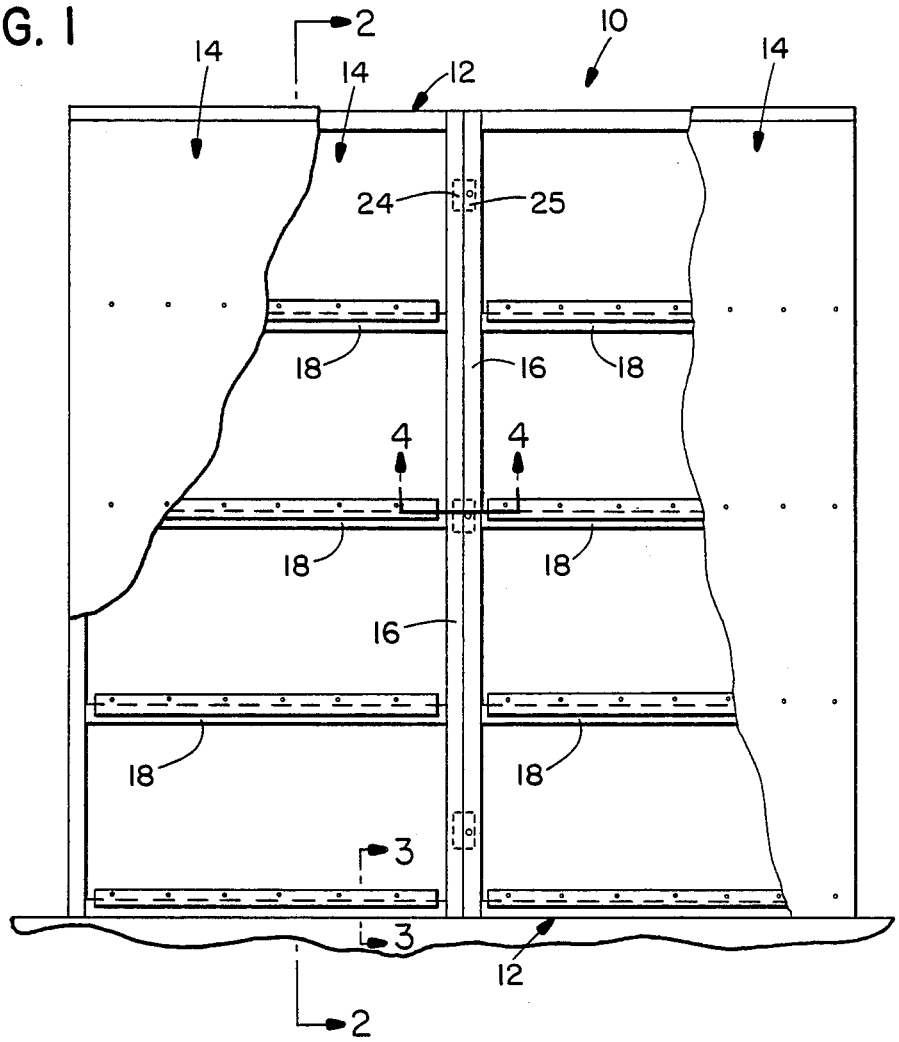
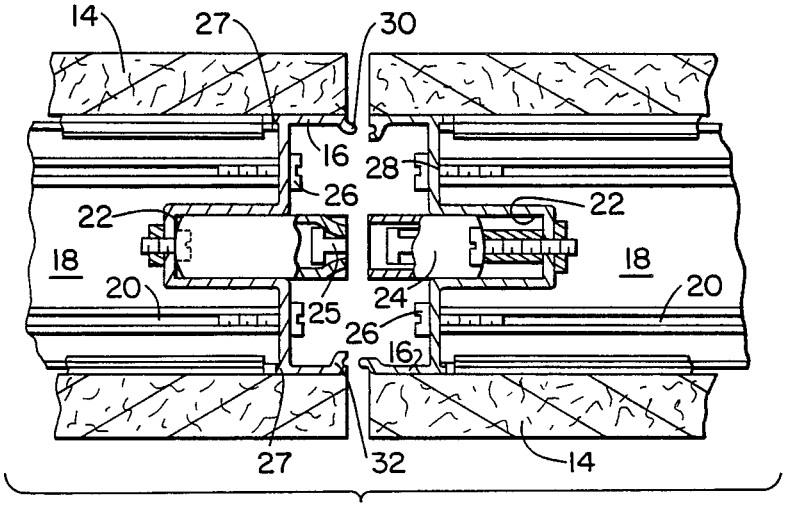
FIG. 4

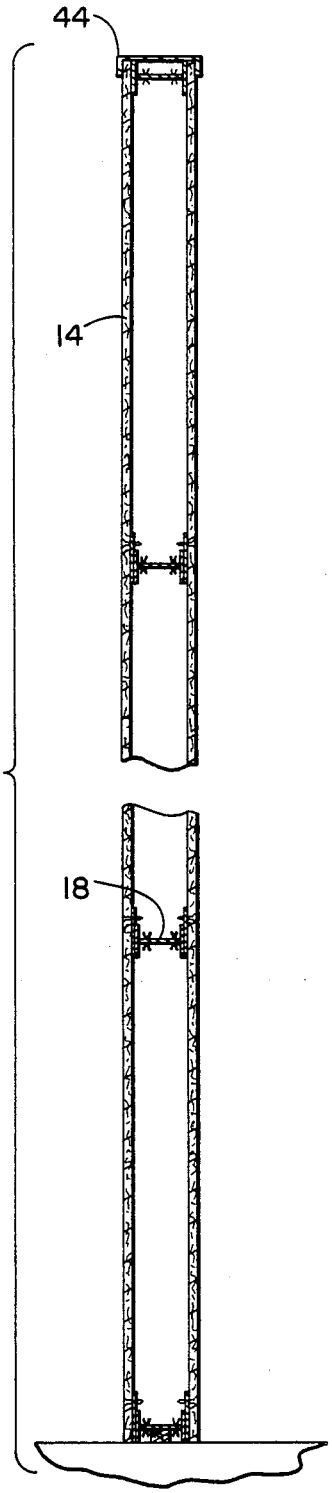
FIG. 2
FIG. 3
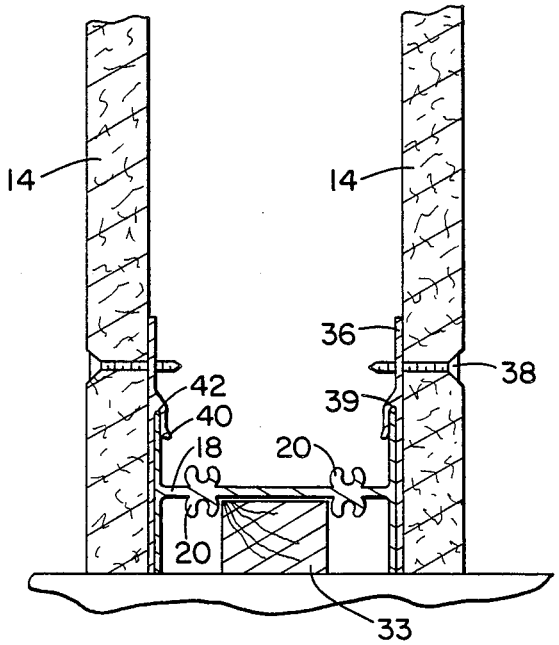

FIG. 5
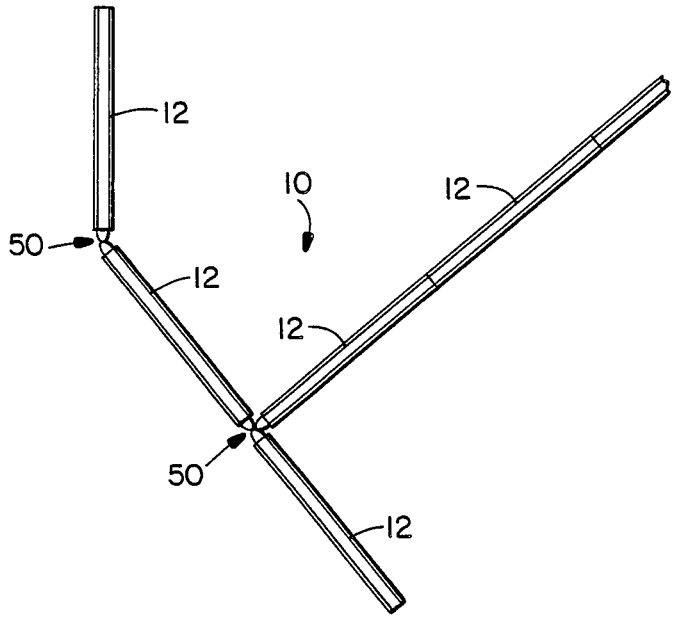
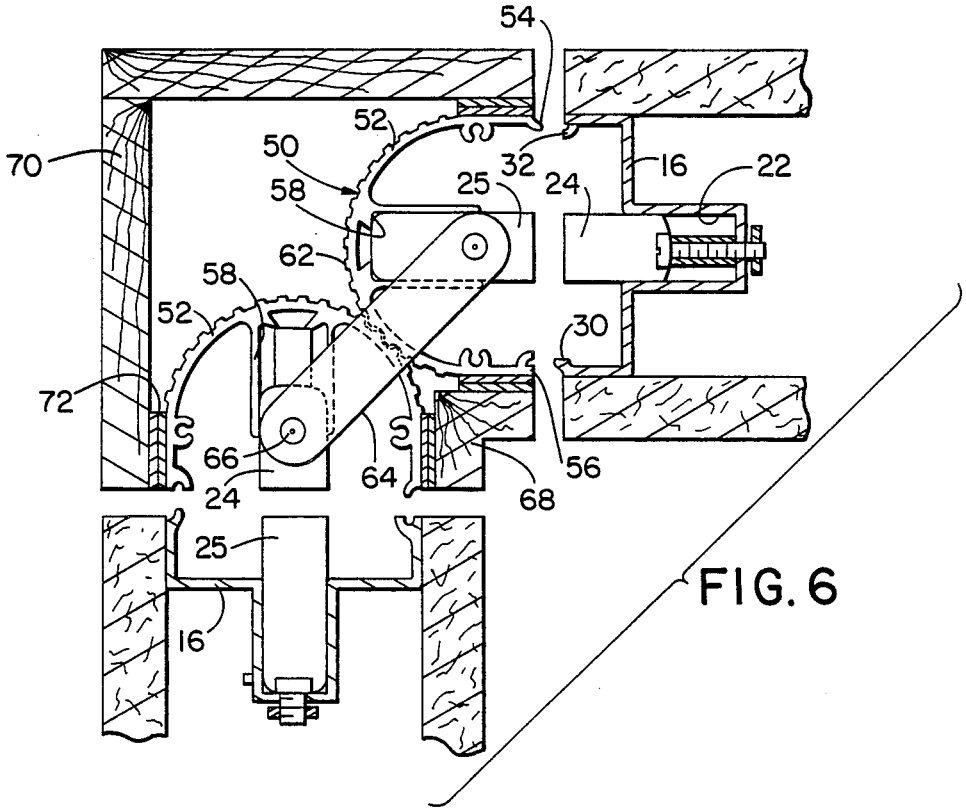
FIG. 6

WALL SYSTEM AND METHOD OF CONSTRUCTION

The present invention relates to wall systems and methods of constructing same.

BACKGROUND OF THE INVENTION

Conventionally, partition walls are constructed by erecting wood and/or metal studs on 16 inch centers and fastening sheet rock, paneling or other wall covering material onto the studs. Generally, such walls cannot easily be disassembled after construction. If a partition wall is to be removed or relocated, it is very difficult to reuse the wall materials. If new walls are desired, the old walls are usually torn down and discarded and new walls are built from scratch.

It would be highly advantageous to provide a wall system which is easily constructed and which has reusable components.

SUMMARY AND OBJECTS OF THE INVENTION

The present invention provides a wall system comprised of wall frame components and wall covering components. The wall frame components include a pair of spaced vertical supports and an array of selectively spaced cross members spanning between and rigidly attached to the vertical supports. Pinch bars, designed to matingly engage the frame cross members are mounted on wall covering components in a matching spaced array. The wall covering components are secured to the wall frame component by matingly engaging the pinch bars with the cross member supports.

Additionally, the wall frames may include locking connectors such that vertical supports of multiple frame components can be serially locked together to form a wall system of any desired floor plan configuration. An infinitely variable hinge frame corner connector and a universal medial connector are provided to facilitate the construction of non-linear and/or complex floor plan configurations.

It is the object of the present invention to provide a wall system which facilities on-site construction in a time efficient manner.

It is also an object of the invention to devise such a wall system which may also be easily disassembled without substantially damaging the component parts thereof.

It is a further object of the invention to provide a wall system which facilitates the reuse of wall materials in subsequent wall construction.

BRIEF DESCRIPTION OF THE DRAWINGS

FIG. 1 is an elevated view of wall, having a portion of the wall covering material cut away, constructed in accordance with the teachings of the present invention;

FIG. 2 is a cross section of the wall depicted in FIG. 1 along lines 2—2;

FIG. 3 is an enlarged view of a portion of the cross section of the wall shown in FIG. 2;

FIG. 4 is an enlarged top view of a section of the wall system along lines 4—4;

FIG. 5 is a top view of a plurality of wall sections made in accordance with the present invention serially locked together in a selected layout constructed in accordance with the teachings of the present invention;

FIG. 6 is a top view of two wall sections joined by a hinge frame corner connector at right angles made in accordance with the teachings of the present invention;

DETAILED DESCRIPTION OF A PREFERRED EMBODIMENT

Figure 9:
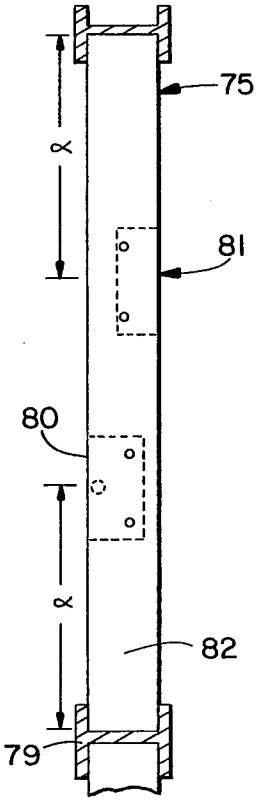
FIG. 9 is a side view of the medial connector shown in FIG. 8.

With reference to FIG. 1, the wall system 10 is comprised of wall frame members 12 and associated wall frame covering means 14 such as sheet rock, paneling, fiber board or the like. Each wall frame 12 comprises two spaced vertical supports 16 and an array of cross members 18 extending between and rigidly connected to the vertical supports of 12.

As best seen from FIG. 3 and 4, the cross members 18 have a generally uniform I-beam beam cross-sectional shape having screw receiving channels 20 defined therein. The vertical members 16 are also generally uniform in cross sections and have a channel 22 defined therein for receiving respective locking portions 24, 25 of a locking mechanism.

In the preferred embodiment, both the vertical supports 16 and connecting cross members 18 are extruded from aluminum generally having a thickness of approximately $0.06 \pm 0.006$ inches. Although aluminum is preferred, steel, plastics, or other material could be used to fabricate the vertical and horizontal members.

As shown in FIG. 4, the extruded cross members 18 are notched to accommodate the channel 22 defined in the vertical support 16. The vertical supports 16 include opposing ridges 27 within which the ends of the cross members 18 are received. In assembly, the cross members are orthogonally abutted against the support 16 and fastening means 26, such as screws or the like, are used to secure the cross members 18 to the vertical supports 16. Preferably pilot holes 28 are drilled or punched in the vertical supports at predetermined locations with which the cross member screw channels 20 are aligned. This assures the uniform spacing of the cross member array for each of the wall frames being assembled.

The vertical supports 16 are selectively configured for self-mating alignment. One edge of the vertical support 16 is extruded as a tongue 30 while the opposing edge is extruded with a slight groove 32. In the assembled frame 12, the edges of the left hand vertical member and right hand vertical member face outwardly from the frame 12 thereby having their respective tongue 30 and groove 32 portions on opposite sides of the wall frame. Accordingly, when two wall frames 12 are joined together, the extruded tongue 30 of the one frame engages the extruded groove 32 of the other frame on one side and vice-versa on the other side of the assembled wall frames. Thus aligned, the locking engagement of the respective locking elements 24, 25 is facilitated. The tongue and groove engagement provides a strong, smooth joint between the wall frames.

In the preferred embodiment, the vertical supports 16 have a vertical axis of symmetry so that they can be used as either left-hand or right-hand supports. This feature facilitates manufacturing since only one form of extrusion is needed for constructing the wall frames.

As best seen from FIG. 3, a plywood spacer 33 is secured to the bottom cross member 18 of the frame 12. The spacer 33 facilitates securing the frame 12 to the floor where the wall is to be positioned. Nails, bolts or other conventional means may, accordingly, be employed to suitably secure the wall frame units to a floor surface without unduly deforming the bottom extrusion. For complex, non-linear wall partition layouts such as depicted in FIG. 5, the locking of the wall frames together creates a free standing structure so that the frames need not be individually anchored to the floor. However, some anchoring is generally desired to prevent lateral movement of the partition walls.

Sheet rock, paneling or other wall frame covering material 14 is prepared for assembly with the wall frames 12 by securing an evenly spaced array of horizontal pinch bars 36. Screws 38 or other means are used to securely fasten the pinch bars 36 to the wall covering material 14. The spacing of the pinch bars 36 is selected to match the spacing of the frame cross members 18. Alternatively, the pinch bars can be placed on the cross members and the wall covering material can be secured to the pinch bars in situ.

The pinch bars 36 are also preferably aluminum extrusions and have a channel 39 defined therein which includes a flared lip 40. The channel 39 is configured to receive the upper edge 42 of cross members 18; the flared lip 40 facilitates mating engagement.

The pinch bars 36 extend across the width of the wall covering material 14 to within approximately one or two inches of the edge of the wall covering 14. The wall covering is assembled to the frame by matingly engaging the pinch bars with the upper edges of the respective cross members 18 as shown in FIGS. 2 and 3. As can be seen in FIG. 4, the edge portions of the wall covering material 14 are flush with the sides of the vertical supports 16 when the wall covering 14 is mounted to the frame 12.

The wall frames 12 may be covered on one or both sides depending upon the user's requirements for either a single or double sided wall. After the wall covering 14 is assembled with the wall frame 12, an extruded aluminum cap member 44 is fitted across the top of the assembled wall unit.

The wall covering material 14 preferably conforms in height and width to the dimensions of the wall frame 12. In practice, wall covering material of a standard size, such as 4'×8' or 5'×9', is selected and the frames 12 are manufactured to accommodate the selected dimensions. Preferably four cross members 18 and associated pinch bars 36 are used where the wall units are from eight to nine feet in height.

Each vertical support 16 includes three locking members preferably located in the middle, proximate the top, and proximate the bottom of the vertical member 16 mounted within channel 22 of the vertical support member 16. The locking members 25 within the left-hand vertical supports are configured to lockingly engage with complementary locking members 24 mounted in the right-hand vertical support 16.

Linear wall sections are constructed by engaging the respective left-hand and right-hand vertical members of two wall frames and locking them together. One suitable type of locking mechanism is commercially available under the trademark "Rotolock" manufactured by the Simmons Fastener Corporation.

A hinged connector 50 is provided comprised of at least two semicircular hinge members 52. The hinge members 52 are preferably aluminum extrusions having a tongue portion 54 formed on one edge and the groove portion 56 formed on the opposing edge configured for mating engagement with the respective groove 32 and tongue 30 of the wall frame vertical supports 16. The hinge members 52 also have a channel 58 wherein the complementary lock members 24, 25 are mounted for lockingly engaging with the respective lock members 24, 25 mounted within the wall frame vertical supports 16.

The hinge members 52 have an array of ribs 62 extruded thereon which meshingly engage with the like ribs of an associated hinge member 52. Two hinge members 52 are joined together by link 64 which is pivotally mounted on pins 66 at the center of the radius of the semicircular extrusions 52. Pivotal link members 64 are secured both at the bottom and the top of the hinge members 52. The links 64 maintain the respective ribs 62 of the hinge members 52 in meshing engagement. This rotation of the hinge members 52, with respect to each other, is permitted over a radius of approximately 300°.

As shown in FIG. 5, three hinge members 52 may be joined together to form a "T" or other angular joint, if desired. It will be recognized by those of ordinary skill in the art that fixed-angle cover connector extrusions can be fabricated for mating engagement with two or more frame members in a fixed position. For example, a "T" extrusion could be made to connect three wall frames in a "T" formation.

Depending upon user preference, the corner connector members used in constructing a desired partition wall system may be left exposed or may be fitted with custom corner covers such as shown in FIG. 6. Wood or other material may be customly configured at the desired angle as corner covers 68, 70. Velcro or other material 72 can be used to secure the covering material 68, 70 to the corner connector 50.

Preferably, the wall frames and hinge members are first assembled into a selected configuration, such as shown in FIG. 5. Thereafter, the wall covering units 14 are hung on the assembled frame members with custom connector covers 68, 70 being utilized as desired.

Where sheet rock is used as the wall covering material, it may be desirable to tape and spackle same as well known in the art to create a seamless wall. Thereafter, wallpaper or paint can be applied in a conventional manner.

Disassembly of the wall system is relatively simple. The top caps are removed and the panels of wall covering materials are lifted off the wall frame. Where sheet rock panels have been employed which are taped and spackled together, the tape is cut along the edge of the panels permitting removal of the individual sheet rock panels. The frames and hinge connectors assemblage is disassembled by disengaging the locking members 24, 25.

Although the wall system is designed to facilitate quick, efficient assembly and disassembly for temporary wall partition needs, the wall system has sufficient structural integrity to be utilized as permanent structures for wall partitions.

In addition to employing full size wall frame units, additional wall frames can be used and fashioned in similar manner to provide half walls adjoining full wall segment or other configurations which are desired for end use. Additionally, selected apertures may be punched in the vertical and cross member extrusions to facilitate wiring for electrical, telecommunications or other purposes.

Figure 8:
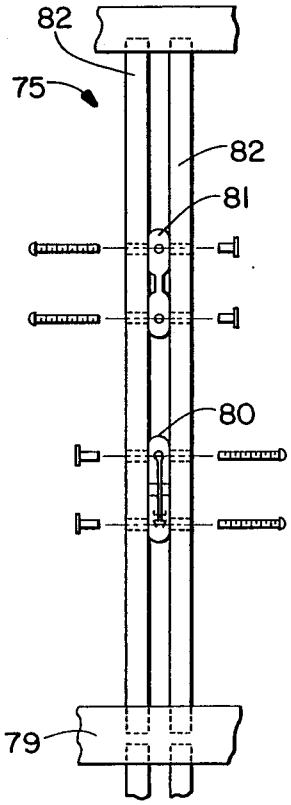
FIG. 8 is a partial exploded front view of a medial connector shown in FIG. 7.
Figure 7:
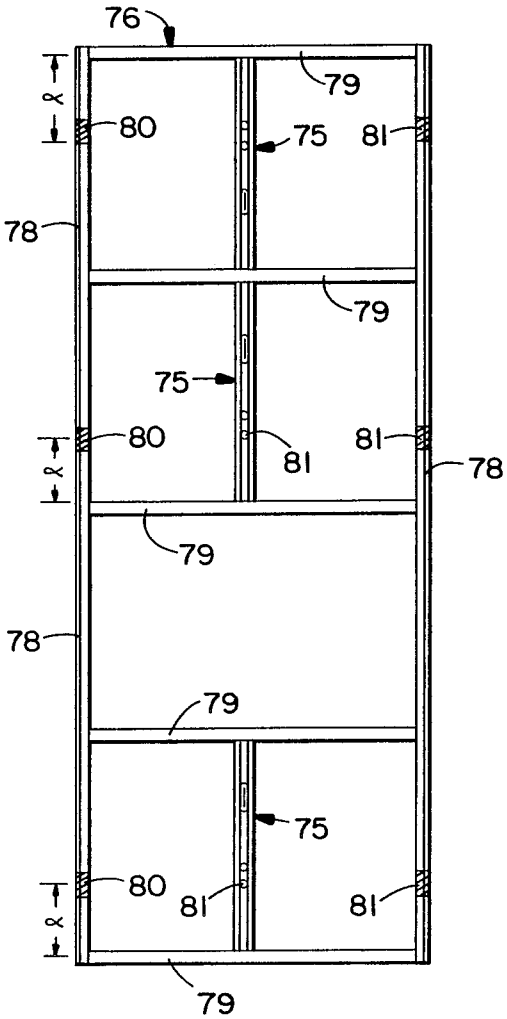
FIG. 7 is an elevated view of an embodiment of a wall frame made in accordance with the present invention having medial connectors disposed therein.

As shown in FIGS. 7, 8 and 9, in lieu of using corner connectors or joining the wall frames end-to-end, medial connectors 75 can be provided to orthogonally join one wall frame to a medial portion of another wall frame 76.

Where medial connectors are used, vertical supports 78 of the wall frame 76 are constructed with their locking members a selected distance $\alpha$ from respective cross members 79. Although the middle locking member of each vertical support 78 is not at the vertical center of its respective support, it will be recognized that a vertical axis of symmetry for the vertical support extrusion is maintained so that vertical support extrusions may be used for either left-handed or right-handed vertical supports. However, when the wall frame 76 is assembled, male locking members 80 are mounted on one side of the wall frame 76 and female locking members 81 are mounted on the vertical support of the other side of wall frame 76.

As shown in FIGS. 8 and 9, the medial connector comprises a pair of spaced support members 82 between which are fastened a male connector 80 facing outwardly in one direction and a female connector 81 facing outwardly in the opposite direction. The male connector 80 is mounted the distance $\alpha$ from one end of the medial connector 75 and the female connector 81 is mounted a distance from the opposite end of the medial connector the distance o; the overall end to end dimension of the medial connector 75 is substantially equal to the spacing of the cross supports 79.

The medial connector 75 so constructed serves as a universal connecting means. Three such medial connectors 75 can be disposed between respective cross support 79 such that either three male or three female locking members are outwardly facing from the same side of wall frame 76 for connection with a vertical support of a second like wall frame (not shown).

Although a presently preferred embodiment has been disclosed, other variations and combination uses of the wall components and system will be readily apparent to those skilled in the art and are within the scope of the present invention.

What we claim is:

1. A method of constructing a wall system:

(a) providing a plurality of wall frames including:

(i) a pair of spaced complementary vertical supports having means for lockingly engaging respective complementary vertical supports, and (ii) an array of cross members spanning between and rigidly attached to said vertical supports;

(b) connecting said wall frames in series by lockingly engaging complementary vertical supports of respective wall frames together; and (c) covering at least one side of said series of connected wall frames with a plurality of wall frame covering means having means for matingly engaging said frame cross member arrays by matingly engaging said wall frame covering means with said wall frames.

2. A method of constructing a wall frame system according to claim 1 further comprising:

(a) assembling said vertical supports with said cross members such that said cross members are evenly spaced at a selected spacing; and (b) securing said cross member engaging means to said wall frame covering means such that said engaging means are evenly spaced to correspond with the selected spacing of said frame cross members.

3. A method of constructing a wall system according to claim 1 further comprising:

(a) providing hinge means having a first means for lockingly engaging one of said wall frame vertical supports hingedly connected with a second means for lockingly engaging a complementary wall frame vertical supports; and (b) hingedly connecting at least two wall frames together by lockingly engaging one of said wall frames to said first hinge locking means and lockingly engaging the second of said wall frames to said second hinge locking means.

4. A method of constructing a wall system:

(a) providing a plurality of wall frames, each including:

(i) a pair of spaced complementary vertical supports having means for lockingly engaging a complementary vertical supports; and (ii) an array of cross members spanning between and rigidly attached to said vertical supports;

(b) providing hinge means having a first means for lockingly engaging one of said wall frame vertical supports hingedly connected with a second means for lockingly engaging a complementary wall frame vertical supports; and (c) hingedly connecting at least two of said wall frames together by lockingly engaging one of said wall frames to said first hinge locking means and lockingly engaging the second of said wall frames to said second hinge locking means.

5. A method of constructing a wall system according to claim 4 further comprising;

(a) covering at least one side of said hingedly connected wall frames with a plurality of wall frame covering means having means for matingly engaging said frame cross member arrays by matingly engaging said wall frame covering means with said wall frames.

6. A method of constructing a wall system according to claim 5 further comprising;

(a) assembling said vertical supports with said cross members such that said cross members are evenly spaced at a selected spacing; and (b) securing said cross member engaging means to said wall frame covering means such that said engaging means are evenly spaced to correspond with the selected spacing of said frame cross members.

7. A wall system comprising:

(a) a plurality of wall frames each including;

(i) a pair of spaced complementary vertical supports having means for lockingly engaging a complementary vertical supports, and (ii) an array of cross members spanning between and rigidly attached to said vertical supports;

(b) medial connector means mounted between respective cross members of a first one of said wall frames for lockingly engaging the wall frame vertical supports of a second of said wall frames; and (c) said first and second wall frames connected together by said medial connector means.

8. A wall system according to claim 7 wherein said medial connector means orthogonally connects said first and said second wall frames in a "T" configuration.

9. A wall system according to claim 7 wherein third and fourth wall frames are connected, respectively, to opposing vertical supports of said first wall frame.

* * * * *

UNITED STATES PATENT AND TRADEMARK OFFICE

CERTIFICATE OF CORRECTION

PATENT NO. : 4,976,080

DATED : December 11, 1990

INVENTOR(S) : Zegel et al.

It is certified that error appears in the above-identified patent and that said Letters Patent is hereby corrected as shown below:

At column 5, line 29, after the word "distance" delete "o" and insert therefor --α--.

Signed and Sealed this

Twelfth Day of May, 1992

*Attest:*

DOUGLAS B. COMER

*Attesting Officer*

*Acting Commissioner of Patents and Trademarks*